US006257166B1

(12) United States Patent
Lieng

(10) Patent No.: US 6,257,166 B1
(45) Date of Patent: Jul. 10, 2001

(54) ANCHOR

(75) Inventor: Jon Tore Lieng, Harald (NO)

(73) Assignee: Leiv Eiriksson Nyfotek AS, Trondheim (NO)

( * ) Notice: Subject to any disclaimer, the term of this patent is extended or adjusted under 35 U.S.C. 154(b) by 0 days.

(21) Appl. No.: 09/582,193

(22) PCT Filed: Dec. 10, 1998

(86) PCT No.: PCT/NO98/00372

§ 371 Date: Jun. 29, 2000

§ 102(e) Date: Jun. 29, 2000

(87) PCT Pub. No.: WO99/33699

PCT Pub. Date: Jul. 8, 1999

(30) Foreign Application Priority Data

Dec. 30, 1997 (NO) ..... 19976160

(51) Int. Cl.[7] ..... B63B 21/28

(52) U.S. Cl. ..... 114/295; 114/299

(58) Field of Search ..... 114/294–295, 297, 114/299, 301

(56) References Cited

U.S. PATENT DOCUMENTS

| | | | | |
|---|---|---|---|---|
| 2,993,461 | * | 7/1961 | Feiler | 114/294 |
| 3,036,542 | * | 5/1962 | Robinson | 114/294 |
| 3,154,042 | | 10/1964 | Thomason et al. . | |
| 3,520,268 | | 7/1970 | Bower . | |
| 6,106,199 | | 8/2000 | Medeiros, Jr. et al. | 405/224 |

* cited by examiner

*Primary Examiner*—Jesus D. Sotelo
(74) *Attorney, Agent, or Firm*—Dennison, Scheiner, Schultz & Wakeman

(57) ABSTRACT

Method for installing an anchor that is released in the sea, especially for installation of in soft seabed sediments. An anchor is rebased in free fall from an at rest position or nearly at rest position and with the longitudinal axis vertical from a position in the water, and that ensures directional stability and nonroutional acceleration during movement towards the seabed. The anchor body (14) has a main member or shank (22) with a regular cross section, especially circular or regular polygon form, with tip (23) and with upward projecting shank (25) with lower average density than the main anchor body has. The anchor body is shaped such that the center-of-gravity lies lower than the middle of the total anchor length and below the average distance to the sum of all the fluid forces which ensures directional stability and nonrotational acceleration during free fall and penetration into the seabed sediments.

12 Claims, 3 Drawing Sheets

ANCHOR

The invention involves a method as described in the introduction to patent claim 1, and an anchor as described in the introduction to claim 2, where an anchor element may be released freely to the seabed and penetrate into the sediments in order to serve as anchoring for a platform or a surface vessel, for example.

BACKGROUND

In the Norwegian patent document no. 142,389, an anchor is described that may be driven into the seabed by a ram or weight, which is fastened to the anchor. The ram is operated by a hoisting wire which runs up to a surface vessel, and allows the anchor to be driven into the seabed until the ram does not allow further penetration. This is not satisfactory for cases where a safe anchoring of a large structure or floating system in loose seabed sediments is require&

In U.S. Pat. document No. 3,850,128, is described a method to drive an anchor into the seabed through use of vibrations. Here a cylinder shaped rod has four flukes forming a cross that guides penetration. This anchor is dependent on external manipulation to be able to penetrate the seabed and can therefore not be dropped.

OBJECTIVE

The main objective with the invention is to derive an anchor that through free fall may penetrate deep into the seabed such that the whole anchor is engulfed in relatively strong sediments. It is important that the anchor during the drop phase in water be held accurately in a vertical position and not rotate, but hold a linear motion during descent. Furthermore it is a subobjective to create a connection for the anchor line that transfers tension forces to the anchor such that a favorable load distribution develops.

INVENTION

With such an anchor it is possible to obtain penetration depths of 20–30 meters in soft seabed sediments with an anchor weight of 60–70 tons. The main effect lies in the stable anchor motion during the drop phase without rotation, and the low center of gravity in relation to the fluid forces which ensures that the anchor body does not tilt in the water phase or when it realizes penetration resistance from the sediments, but continues in a straight line fashion during the whole descent.

BRIEF DESCRIPTION OF THE DRAWINGS

The invention is described in more detail below with reference to the drawings, where FIG. 6 shows a side view of the arrangement for the second anchor line in FIG. 5, while

DETAILED DESCRIPTION

In this description, the term anchor means the anchor body, which is dropped from a height over the seabed which penetrates the sediments and the lines, chains or fastening arrangements that are used to connect the anchoring element to a hoisting vessel during installation and to the structure that shall be anchored.

Figure 1:
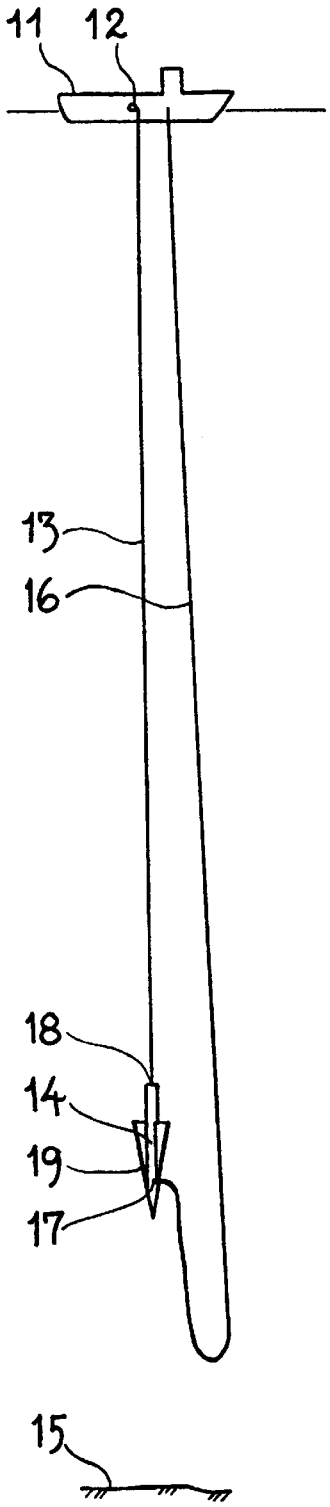
FIG. 1 shows a schematic outline of an anchor in agreement with the invention where the anchor body is suspended ready for installment, with a combined drop line and anchor line.

In FIG. 1 is shown a vessel 11 with a winch 12 that has a combined drop and first anchor line 13 which holds an anchor body 14 suspended approximately 20 m over the seabed 15. The winch 12 may be constructed in such a way that it can feed out the anchor line by motorized operation when the anchor is dropped, so that the anchor and its elements may drop freely to the seabed 15.

Figure 2:
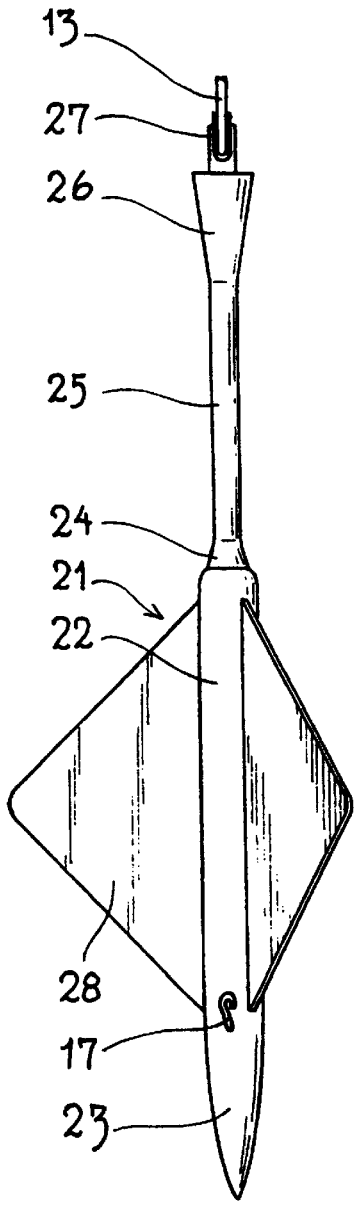
FIGS. 2–4 show perspective drawings of alternative anchor shapes.

In addition to the first anchor line 13 there can be found a second anchor line 16 that is affixed to a fastening hook 17 at the front end of the anchor body 14 and that is laid out so that it lies freely in the sea FIG. 2 shows an example of one design of the anchor body 21. It has a main part or shank 22 having a cylindrical shape with bottom tip 23, which tapers 24 to a thinner part of the shank 25. At the top end, the shank 25 tapers out 26 towards a holding ring 27 for the anchor line 13. The main shank 22 has in this case three vertical flukes 28. The main shank 22 and upper part 25 of the shank may be shaped out of one type of material or put together by some practical method comprised of two parts and may also have the same cross section, in that both the upper and lower shank may be made of tubing filled with suitable ballast material.

During manufacturing with a massive material, the center-of-gravity for the anchor shank 22 will lie at the same place as the geometrical center and lie in the lower part of the anchor body. During manufacturing with composites, for example steel and concrete, and a cylindrically shaped shank 25, the center-of-gravity can be moved further towards the anchor tip 23, so that it will lie below the geometrical center.

With the anchor as a reference point, the water and soil will flow past the anchor body's surface area, mainly parallel to anchor movement. The anchor has a shape such that if the anchor starts to rotate about the horizontal plane, the viscous forces from the flowing fluid will increase on the outward tilting side and force the anchor back in vertical position. The low center-of-gravity helps to maintain rotational stability during descent. This is especially true for the anchor shown in FIG. 3.

Figure 3:
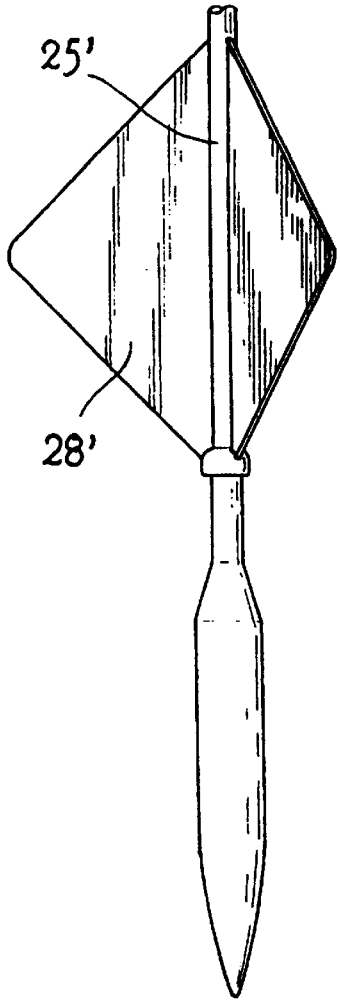

In FIG. 3 is shown an alternative design where the basic shape is the same as in FIG. 2, but where the flukes 28' are moved further up towards the top of the shank 25'. An alternative design may include flukes on both the upper and lower part of the anchor shank.

Figure 4:
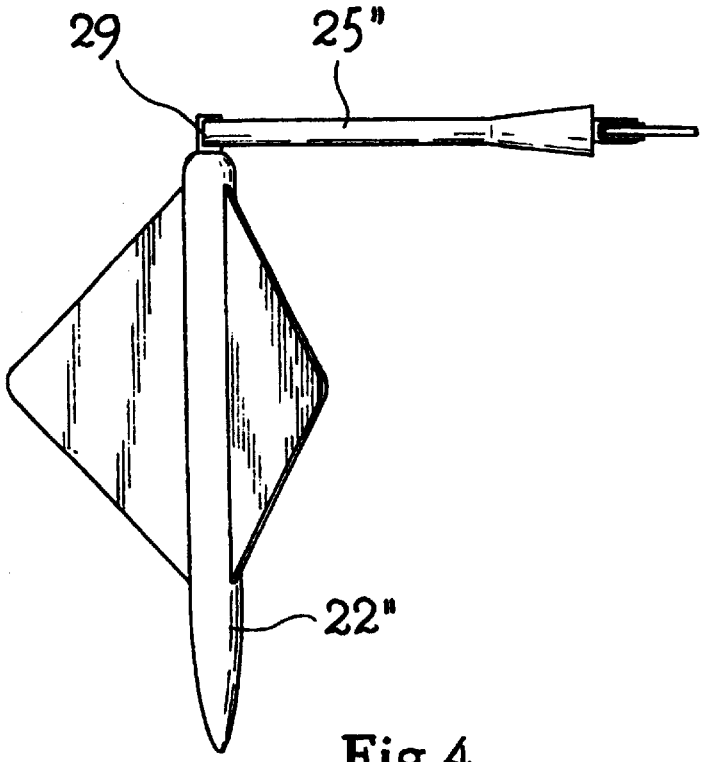

In FIG. 4 an additional design is shown, where at the tapered part of the shank 24, between the lower 22" and upper 25" shank ends, is introduced a joint 29 which allows up to ca. a 90° bend between the two shank halves. The reason for this joint is described below with reference to FIG. 7.

Figure 5:
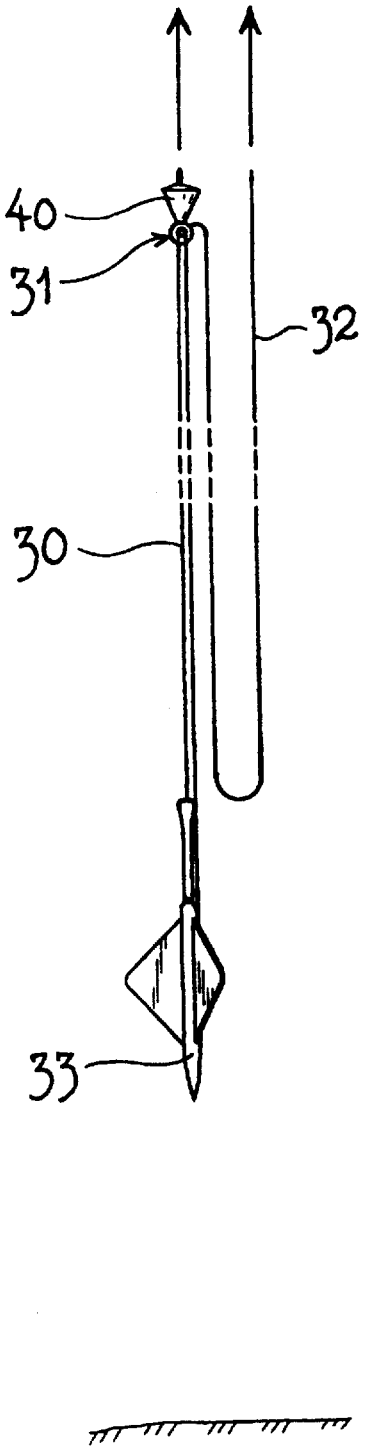
FIG. 5 shows a side view of an anchor in agreement with the invention, with an integrated second anchor line.
Figure 6:
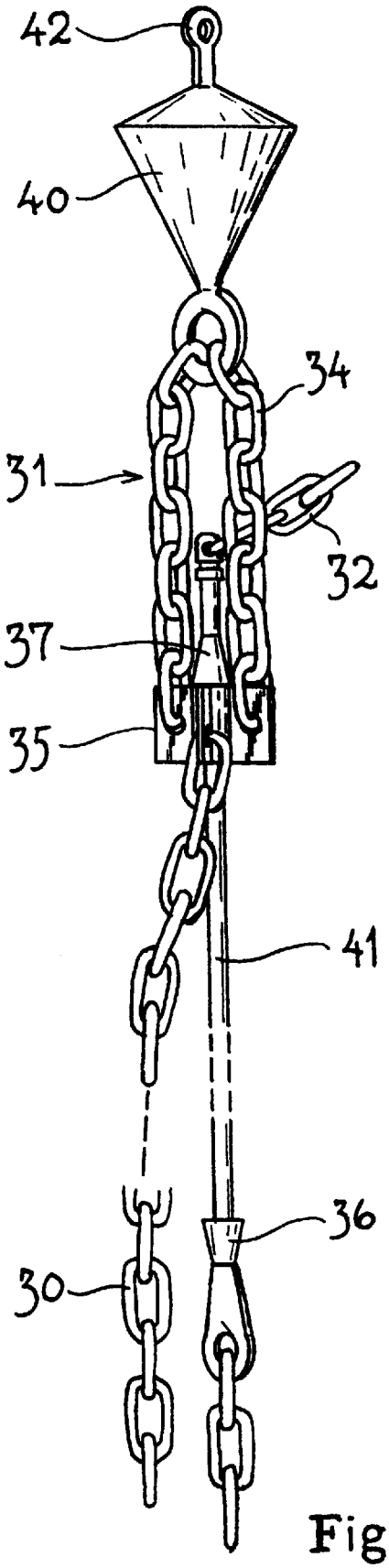

In FIG. 5 is shown a design shape of the invention, where the anchor comprises an anchor body as shown in FIG. 2. On the anchor line 13, which at the lower end comprises a chain 30, there is, a distance over the holding ring 27 equivalent to 4 to 6 times the total length of the anchor body 21, arranged a guide 31 for a second anchor line 32 which runs down to a fastening ring 33 on the lower part of the anchor. Details of this arrangement is shown in FIG. 6. The guide 31 is fashioned such that a short section of chain 34 is fastened to the chain 30 via a slide element 35. At each end of the guide rod 41, which connects to the anchor line 32 and runs through the guide 31, there are stop lugs, the lower 36 and upper 37, respectively. Before dropping the anchor, the second anchor line 32 is suspended via the lug 37 on top of the slide element 35. In this position, both anchor lines 30 and 32 are suspended parallel and hanging down towards the anchor body 21. During the drop phase, the cone shaped drag element 40, fastened to the anchor line 13, will brake the movement of the anchor lines 30 and 32, such that these are held taut against the anchor 21 and helps guide the anchor in a straight path towards the seabed.

During installation of the anchor, the anchor body is suspended in the water, for example 20–30 meters over the seabed 15. During the drop phase the anchor body will fall through the water and penetrate into the soft seabed sediments. Due to the shape, in agreement with the invention, the penetration will be sufficiently deep to allow the anchor to serve as an anchoring point for mooring of ships, platforms, wave and tide power stations and other similar structures. The streamlined shape combined with the low center-of-gravity ensures a straight-line path towards the seabed and together with the flukes prohibits rotation of the anchor body. With such straight-line motion without rotation of the anchor body, it is possible to attain penetrations to 20–30 meters with an anchor body weight of 60–70 tons.

In some cases, there may be sufficient function resistance from the soil against the surface area of the anchor body to allow pure vertical loading of the anchor. In such a case, only one anchor line would suffice, connected to the top of the anchor body. The anchor body shown in FIG. 3 would be best suitable for this situation.

Figure 7:
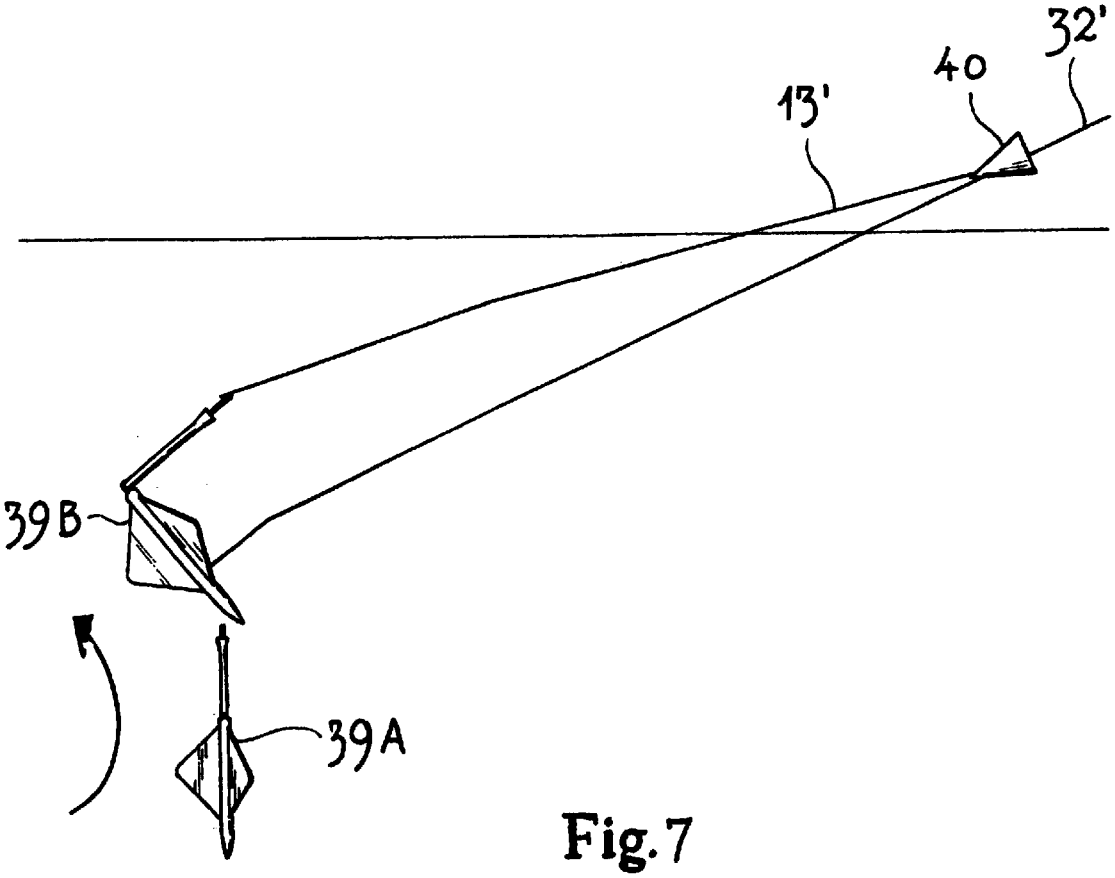
FIG. 7 shows a side view of an anchor in agreement with the invention in a fixed installed state.

FIG. 7 shows how the anchor, in agreement with the invention, can be used for mooring. Here, an anchor body in agreement with FIG. 4, is shown in its original penetrated position in 39A. After tensioning of anchor line 32", the first anchor line 13' will slide along guide 31 (FIG. 6) until the guide rod 41 is stopped by the lower stop lug 36. Further tensioning of the anchor line will cause the upper part of the shank 25" to rotate about the joint 29. Simultaneously, the anchor body will move from position 39A to a somewhat lifted and rotated position 39B. In this position, with side tension in the anchor line, the anchor flukes will receive lateral resistance from the seabed sediments.

The joint 29 stops the anchor body from being lifted during tightening of the anchor line.

The anchor can also be used with one anchor line, that is preferably fastened to the anchor body's lower half, such that there develops a lateral displacement when the anchor line is tautened. Alternatively, the anchor can be equipped with just one anchor line that is fastened to the holding ring 27 (FIG. 2) on the top of the anchor body. This assumes that there is sufficient friction resistance in the soil against the anchor surface area The number of anchor flukes may be between 2 and 8, but most likely 3 or 4. The anchor flukes may be trapeze shaped, curved or triangular with straight terminated edges. The anchor design shown in FIG. 3 is then used.

The cone shaped drag element 40 is equipped with a fastening ring 42 on its top end for suspending the anchor prior to dropping.

An alternative design of the anchor body, the shank is cylindrical throughout its length with decreasing density towards the top end, such that the center-of-gravity lies in the lower half of the anchor body.

What is claimed is:

1. Anchor for lowering into the seabed, comprising: an anchor body (14) with an anchor line (13) for anchoring of a surface structure, such as a vessel or floating platform, with a main shank (22) that is equipped with guide elements such as at least two flukes (19) that stretch radially outwards from the central part of the anchor and axially along the anchor body, with front edges that slant or arch backwards and where the main shank end (22) stretches upwards towards a fastening ring (18) for the anchor line, characterized by that the main shank (22) has a regular cross section, and that the surface area of the flukes is a substantial portion of the total surface area of the anchor, to give sufficient soil friction resistance during loading, and that the center-of-gravity of the anchor is located at or slightly below the center of buoyancy but well below the centroid for the total anchor surface area to give directional stability and counteract rotation during free fall and the seabed penetration.

2. Anchor according to claim 1, characterized by that the anchor body over the main anchor shank (22) has a shank with less density, such as a hollow shank or one that is filled with a less dense material than the main or lower part of the shank.

3. Anchor according to claim 2, characterized by that the flukes (28,28') are fastened to the main anchor shank (22) and/or to the upper part of the shank (25').

4. Anchor according to claim 3 characterized by that the flukes are fastened to the upper part of the shank (25') and there is only one anchor line fastened to the holding ring (27') at the top of the anchor body.

5. Anchor according to claims 2, characterized by that the main anchor body (22") and upper shank (25") are connected by a joint (29) that allows up to a 90° bend, in order to limit the vertical movement of the anchor body during tautening of anchor line.

6. Anchor according to claim 2 characterized by that the flukes are fastened to the upper part of the shank (25') and there is only one anchor line fastened to the holding ring (27') at the top of the anchor body.

7. Anchor according to claim 1, characterized by that there exists a fastening point (17) for an anchor line (16) a distance from the fastening ring (18).

8. Anchor according to claim 7, characterized by that the fastening point (17) for the anchor line is placed between the flukes (19).

9. Anchor according to claim 7 characterized by that a second anchor line (32) is placed through a guide (31) on the first anchor line (13).

10. Anchor according to claim 9, characterized by that the movement of the second anchor line (32) through the guide (31) has its movement limited by two stop lugs (36, 37) that are found a distance from each other on a guide rod (41) in order to allow a certain displacement between the two anchor lines during tautening.

11. Anchor according to claim 9, characterized by that the guide is made up of a chain loop (34).

12. Anchor according to claim 7, characterized by that the fastening point (17) for the anchor line is placed under the flukes (19).

* * * * *